US007670439B2

(12) United States Patent
Elick et al.

(10) Patent No.: US 7,670,439 B2
(45) Date of Patent: Mar. 2, 2010

(54) CHOPPING SYSTEM FOR A DISHWASHER PUMP ASSEMBLY

(75) Inventors: Robert A. Elick, Jackson, TN (US); Thomas M. Johnson, Minneapolis, MN (US); Mark B. Neff, Medon, TN (US)

(73) Assignee: Maytag Corporation, Benton Harbor, MI (US)

( * ) Notice: Subject to any disclaimer, the term of this patent is extended or adjusted under 35 U.S.C. 154(b) by 999 days.

(21) Appl. No.: 11/394,220

(22) Filed: Mar. 31, 2006

(65) Prior Publication Data

US 2007/0227559 A1 Oct. 4, 2007

(51) Int. Cl.
*B08B 3/02* (2006.01)

(52) U.S. Cl. ..... 134/25.2; 134/111

(58) Field of Classification Search ..... 134/25.2, 134/56 D, 104.4, 111, 115 G
See application file for complete search history.

(56) References Cited

U.S. PATENT DOCUMENTS 4,350,306 A * 9/1982 Dingler et al. ..... 241/46.012
4,795,102 A 1/1989 Jordan et al.
4,900,957 A * 2/1990 Barker et al. ..... 310/62
5,165,433 A 11/1992 Meyers
5,165,435 A 11/1992 Thies et al.
5,711,326 A 1/1998 Thies et al.
5,770,058 A 6/1998 Jozwiak
5,779,812 A 7/1998 Thies et al.
5,803,100 A * 9/1998 Thies ..... 134/104.4
5,909,743 A 6/1999 Thies et al.
6,103,017 A 8/2000 Thies et al.
6,182,674 B1 2/2001 Jozwiak et al.
RE37,831 E 9/2002 Thies
6,454,872 B1 9/2002 Miller et al.
7,472,714 B2 * 1/2009 Elick et al. ..... 134/115 G
2006/0174918 A1 * 8/2006 Hedstrom et al. ..... 134/25.2

* cited by examiner

*Primary Examiner*—Michael Barr
*Assistant Examiner*—Saeed T Chaudhry
(74) *Attorney, Agent, or Firm*—John Morrison; Diederiks & Whitelaw PLC

(57) ABSTRACT

A dishwasher includes a pump assembly having a chopper blade and apertured plate arrangement which function to chop soil particles entrained in a flow of washing fluid. The chopper blade floats or axially slides relative to a drive member from a first position spaced from the apertured plate to a second position closer to the apertured plate in order to macerate the soil particles. The chopper blade is actually mounted to a hub member including a shaft portion that extends into and abuts an inner portion of an impeller to maintain a desired spacing between the chopper blade and the apertured plate, while transferring drive from the drive member to both the chopper blade and impeller.

9 Claims, 9 Drawing Sheets

CHOPPING SYSTEM FOR A DISHWASHER PUMP ASSEMBLY

BACKGROUND OF THE INVENTION

1. Field of the Invention

The present invention pertains to the art of dishwashers and, more particularly, to a chopping system for macerating food particles entrained in a washing fluid flowing through a dishwasher pump assembly.

2. Discussion of the Prior Art

In a typical dishwasher, a washing fluid is pumped from a sump into upper and lower wash arms such that kitchenware, retained on vertically spaced racks within a tub, will be sprayed with the washing fluid for cleaning purposes. The washing fluid is heated, filtered and recirculated. Prior to being recirculated, the washing fluid is directed through one or more filters that remove soil entrained in the washing fluid, with the soil being collected in a chamber. Periodically, the system will be purged in order to drain the chamber of soil.

Thus, despite the presence of the filters, some soil particles remain entrained in the washing fluid. In recognition of this condition, many dishwashers employ chopping mechanisms located in the washing fluid flow path. Typically, a chopper blade, driven by a pump motor or other driving means, is rotated adjacent to an apertured chopping plate so as to macerate any soil particles that may remain in the washing fluid. As the chopper blade is but one part of a larger mechanism, maintaining a particular spacing between the chopper blade and the apertured plate during assembly is often difficult.

In order to maintain a predetermined spacing between the chopper blade and the apertured plate, many dishwashers employ a spring element. The spring element is located in such a manner so as to urge the chopper blade towards the apertured plate, while permitting the chopper blade to deflect relative to the apertured plate if a large particle is caught between the blade and the plate. However, for various reasons, the spring element may lose some or all of the force applied to the chopper blade. At that time, the chopper blade-to-plate spacing may fall out of factory specifications, resulting in inefficient operation of the pump assembly.

Obviously, the ability of the dishwasher to thoroughly clean the kitchenware will depend on, among other factors, the ability to properly filter and/or macerate soil particles entrained in the washing fluid. Unless proper spacing is maintained between the chopper blade and the plate, the ability to properly macerate the soil particles could be compromised. Although various systems for maintaining proper blade-to-plate spacing are known in the art, there still exists a need for improvements in this field in order to further enhance the overall cleaning functions and pump durability.

SUMMARY OF THE INVENTION

The present invention is directed to a soil chopping system for a dishwasher pump assembly. An overall dishwasher pump assembly includes two separate pumps, i.e., a recirculation pump for providing a recirculation flow of washing fluid and a drain pump that is utilized during draining or purging operations. Most preferably, all of the washing fluid to be recirculated flows past a radial strainer, through a generally U-shaped inlet trap and then to an impeller of the recirculation pump. Prior to reaching the impeller, the washing fluid flows through the chopping system. The chopping system preferably includes a chopper blade and apertured plate arrangement. In this manner, any large particles contained in the washing fluid are prevented from passing through the strainer, while the remainder of the particles are forced towards the chopper system prior to reaching the impeller of the recirculation pump.

In accordance with a preferred form of the invention, the chopper blade floats, or axially slides, relative to a drive member. Actually, the chopper blade is drivingly connected to a hub member and moves axially with respect to the drive member. More specifically, the drive member extends from a motor to an impeller that establishes the recirculating flow of washing fluid. Thus, once the washing fluid begins to flow towards the impeller, through the apertured plate, a suction force is created that causes the chopper blade to be drawn upward along a shaft portion of the hub member into position adjacent the apertured plate. Correspondingly, in the event that the recirculation pump starves or ceases to operate, the chopper blade will remain spaced from the plate.

In further accordance with the invention, the chopping system includes a bearing member that is arranged so as to establish a minimum clearance between the chopper blade and the apertured plate. Preferably, the bearing member is secured to a lower portion of the apertured plate so that, when the chopper blade is urged into position, the chopper blade abuts the bearing member to establish a predetermined clearance.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
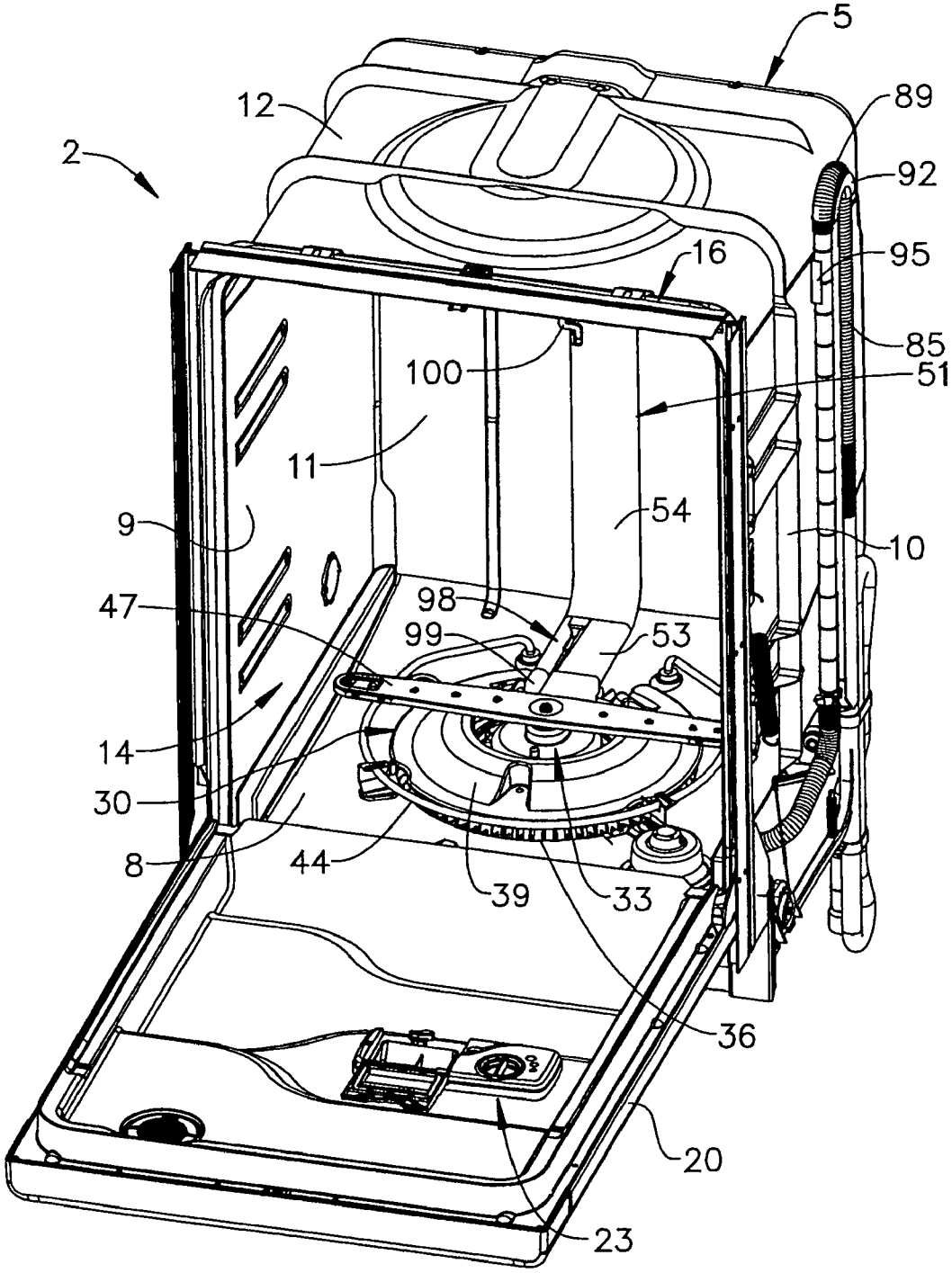
FIG. 1 is an upper right perspective view of a dishwasher constructed in accordance with the present invention, with a door of the dishwasher being open.
Figure 2:
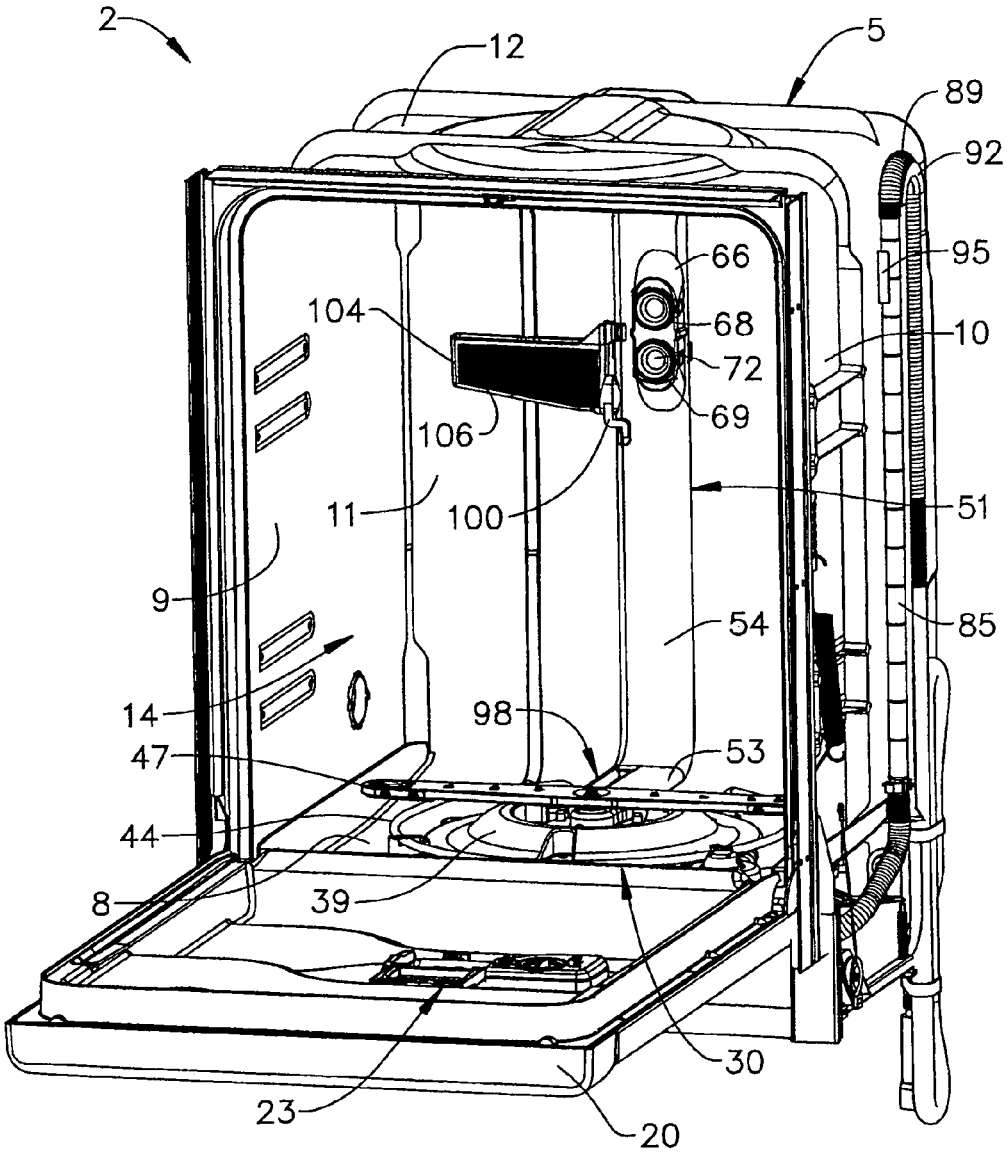
FIG. 2 is another perspective view of the dishwasher of FIG. 1 with the door open.
Figure 3:
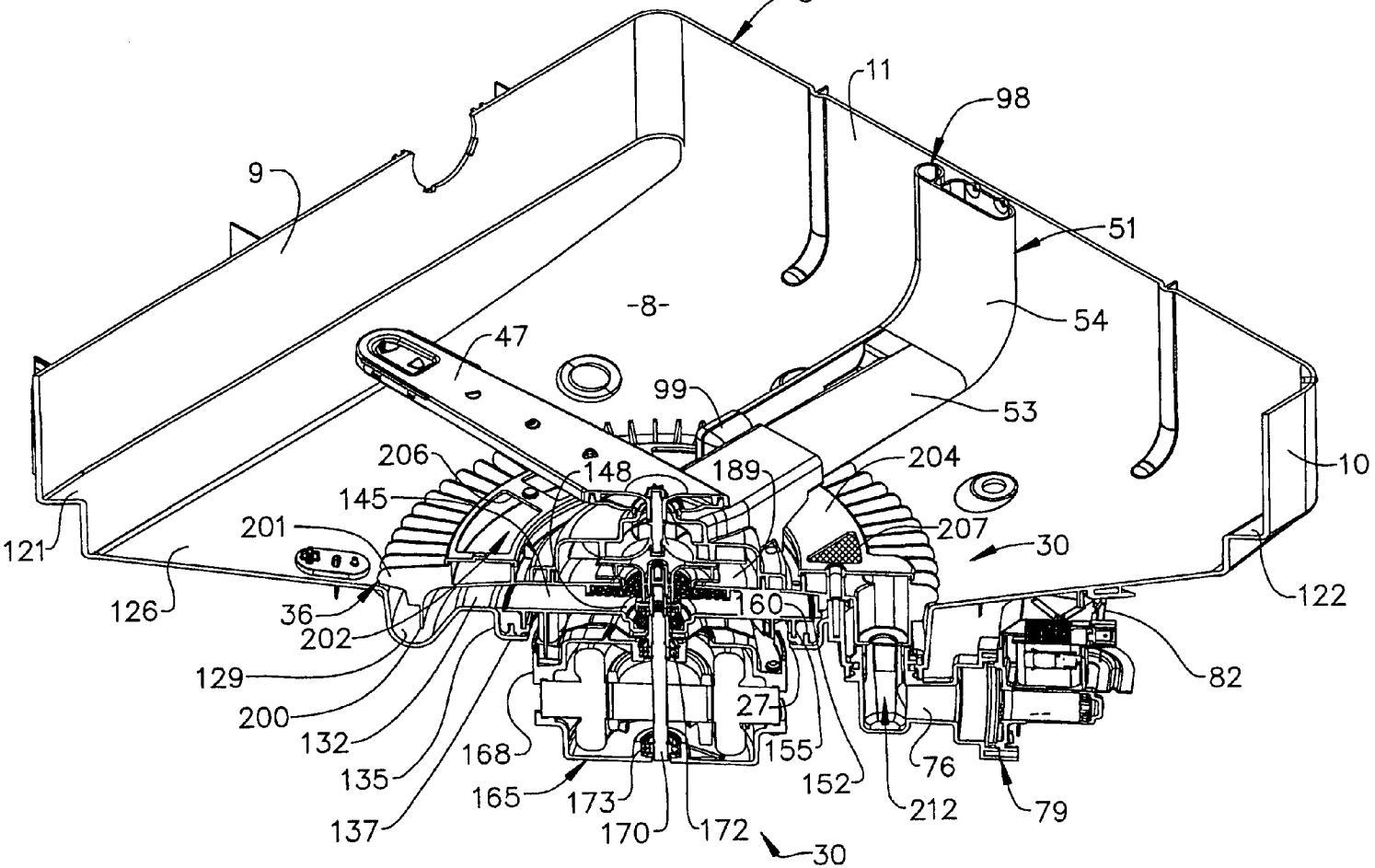
FIG. 3 is an isometric, cross-sectional view through both a tub basin and the overall pump and filtration system of the dishwasher of FIG. 1.

With initial reference to FIGS. 1-3, a dishwasher constructed in accordance with the present invention as generally indicated at 2. As shown, dishwasher 2 includes a tub 5 which is preferably injection molded of plastic so as to include integral bottom, side, rear and top walls 8-12 respectively. Within the confines of walls 8-12, tub 5 defines a washing chamber 14 within which soiled kitchenware is adapted to be placed upon shiftable upper and lower racks (not shown), with the kitchenware being cleaned during a washing operation in a manner widely known in the art. Tub 5 has attached thereto a frontal frame 16 which pivotally supports a door 20 used to seal chamber 14 during a washing operation. In connection with the washing operation, door 20 is preferably provided with a detergent tray assembly 23 within which a consumer can place liquid or particulate washing detergent for dispensing at predetermined portions of the washing operation. Of course, dispensing detergent in this fashion is known in the art such that this arrangement is only being described for the sake of completeness.

Disposed within tub 5 and, more specifically, mounted within a central opening 27 (see FIG. 3) formed in bottom wall 8 of tub 5, is a pump assembly 30. In the preferred embodiment and as illustrated in these figures, pump assembly 30 includes a main housing 33 defining, at least in part, a pump chamber 34 (see FIG. 4), an annular, radial outermost strainer 36 and a filter guard 39. Extending about a substantial portion of pump assembly 30, at a position raised above bottom wall 8, is a heating element 44. In a manner known in the art, heating element 44 preferably takes the form of a sheath, electric resistance-type heating element.

In general, pump assembly 30 is adapted to direct washing fluid to at least a lower wash arm 47 and a conduit 51. As depicted, conduit 51 includes a substantially horizontal, lower section 53 extending away from main housing 33 of pump assembly 30, a vertical section 54 which generally extends along rear wall 11, a generally horizontally extending upper section (not shown) which rotatably supports an upper wash arm (also not shown). Vertical section 54 has attached thereto a wash fluid diverter 66 (see FIG. 2) which defines upper and lower ports 68 and 69. Although not considered part of the present invention, each of upper and lower ports 68 and 69 has associated therewith a valve, such as a flapper element indicated at 72, for preventing any water flowing through conduit 51 from exiting either of port 68 or 69 unless structure is inserted into a respective port 68, 69 so as to deflect a respective flapper element 72. In general, wash fluid diverter 66 can actually be formed with a varying number of ports ranging from 1 to 3 or more. The overall wash fluid diverter 66 is actually designed to cooperate with a vertically adjustable upper rack (not shown) which would carry an associated underside wash arm and respective piping that would become aligned with and project into a respective port 68, 69 in order to deflect flapper element 72 so as to provide an additional wash arm used to further spray washing fluid upon kitchenware, thereby supplementing lower wash arm 47 and an upper wash arm (not shown) during a washing operation within dishwasher 2. In general, vertically adjustable racks, as well as multi-port wash fluid diverters are known in the art such that this structure will not be described further here.

Pump assembly 30 has associated therewith a drain port 76 to which is attached a drain pump 79. Drain pump 79 is secured beneath bottom wall 8 of tub 5 through the use of a suspension bracket 82. Drain pump 79 has associated therewith a drain hose 85 including at least one corrugated or otherwise curved portion 89 that extends about an arcuate hanger 92 provided on an outside surface of side wall 10. Drain hose 85 is also preferably secured to tub 5 through various clips, such as that indicated at 95. In any event, in this manner, an upper loop is maintained in drain hose 85 to assure proper drainage in a manner known in the art.

Also projecting from main housing 33 of pump assembly 30 is an overflow tube 98. More specifically, overflow tube 98 includes a first end 99 leading from main housing 33, as well as a second end 100 which leads into an overflow housing 104. In accordance with the preferred embodiment shown in these drawings, overflow tube 98 is preferably integrated into conduit 51 during manufacturing, such as through a blow molding or extrusion operation. In any event, second end 100 of overflow tube 98 leads out of the overall structure defining conduit 51 to direct fluid from within overflow tube 98 into overflow housing 104. Overflow housing 104 incorporates a coarse filter 106. In one preferred embodiment, filter 106 has openings in the order of 20 mils. Although a removable cover (not shown) could be provided to access filter 106 for replacement/cleaning purposes, filter 106 is preferably molded into housing 104 such that the entire housing/filter unit could be replaced if necessary. However, as will be detailed further below, a backwashing arrangement for filter 106 is preferably employed for cleansing purposes.

As best shown in FIG. 3, side walls 9 and 10 of tub 5 lead into bottom wall 8 through a pair of spaced plateau portions 121 and 122. Rollers for a lower rack (not shown) are adapted to be supported upon plateau portions 121 and 122 for movement of the rack into and out of tub 5. In any event, bottom wall 8 includes a lower base portion 126 which slopes inwardly towards a trough 129. Trough 129 defines an inlet trap which is generally U-shaped in cross-section. Radially inwardly of trough 129, bottom wall 8 includes an inner radial plateau portion 132 that leads to a downwardly extending portion 135 and finally to a substantially horizontally extending innermost portion 137. Innermost portion 137 defines central opening 27 within which pump assembly 30 extends as clearly shown in these figures.

Referring now to FIGS. 3-6, pump assembly 30 includes a lower housing plate 145 that includes a central recess section 148 and an outer edge 152. Spaced slightly inwardly from outer edge 152, lower housing plate 145 is provided with a lower rib 155. As shown, lower rib 155 extends into a notch (not labeled) defined in a seal 160. More specifically, seal 160 is sandwiched between downwardly extending portion 135 and lower rib 155, while also projecting along outer edge 152. In this manner, fluid that flows through trough 129 and along inner-radial plateau portion 132 is prevented from reaching innermost portion 137, but rather is forced to flow above lower housing plate 145.

Pump assembly 30 has associated therewith a motor 165. In general, motor 165 is of a type known in the art and includes an upper motor end cap 168 which attaches to housing plate 145. Motor 165 includes an associated driveshaft 170, which in the embodiment shown, extends through a central recess 171 of upper motor end cap 168 and is rotatably supported by upper and lower bearing units 172 and 173. Driveshaft 170 is provided with a flat region 174 for driving, for example, a fan member 176. Fan member 176 establishes a cooling airflow that is directed onto motor 165 through a plurality of openings, one of which is indicated at 178 (see FIG. 6) in upper motor end cap 168. In addition to driving fan member 176, driveshaft 170 operates other components of pump assembly 30, the details of which will be provided more fully below. Since the general construction and operation of motor 165 is known in the art, it will not be detailed further herein.

Figure 4:
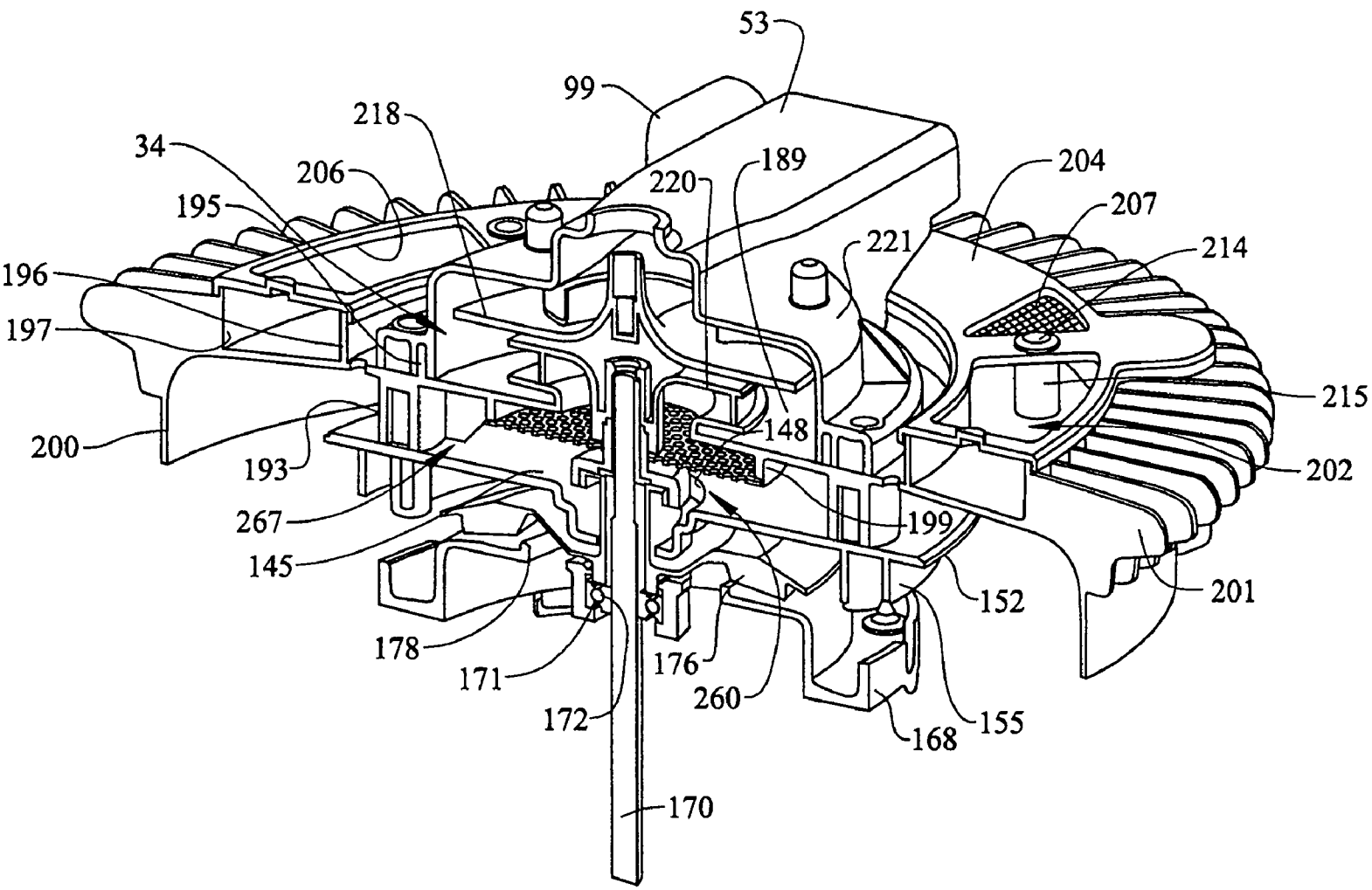
FIG. 4 is a perspective, cross-sectional view through the pump/filtration system illustrating a chopper blade and plate arrangement constructed in accordance with the present invention.
Figure 5:
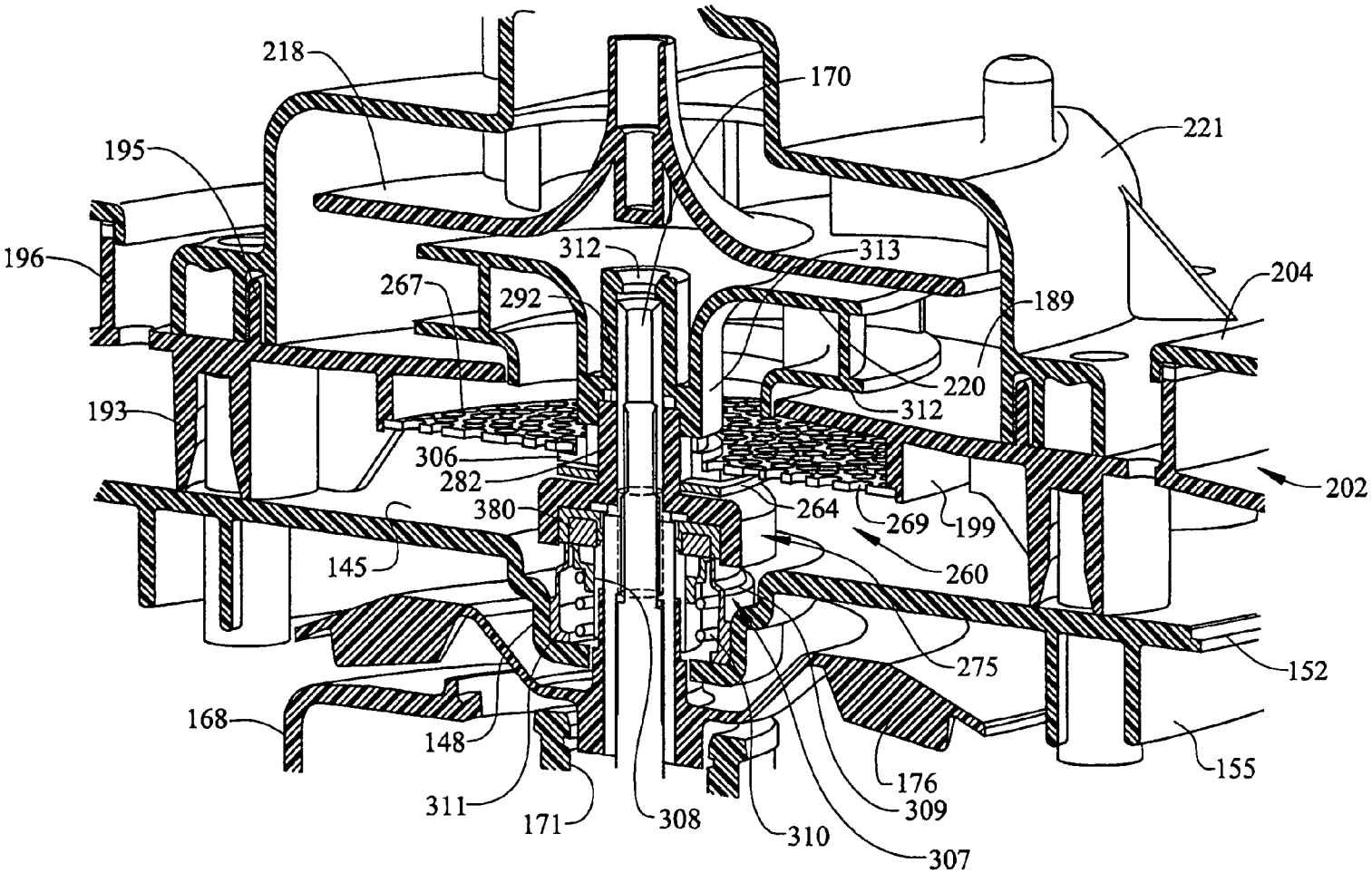
FIG. 5 is a perspective, cross-sectional view through the recirculation pump illustrating the chopper blade and plate arrangement of the present invention.

At this point, it should be noted that pump assembly 30 is provided with an intermediate housing 189 that includes a plurality of annularly spaced bosses, one of which is indicated at 193 in FIGS. 4 and 5, as well as a series of upstanding, radially spaced annular ribs 195-197 which project upward from intermediate housing plate 189. Actually, intermediate housing plate 189 includes a downturned annular rib 199, as well as an additional annular rib 200 which extends downward from intermediate housing plate 189. Rib 200 actually defines a flow plate which projects into trough 129. Projecting from rib 200 are a plurality of upstanding walls 201 that define outermost radial strainer 36. Ribs 196 and 197 extend upwardly, substantially parallel to one another and define a filter chamber 202. A cover 204, which includes a plurality of enlarged openings 206, spans across ribs 196 and 197. As best illustrated in FIGS. 3 and 4, each of enlarged openings 206 has associated therewith a fine mesh screen 207, preferably having openings in the order of 75 microns or 3 mils, for filtering purposes. Filter chamber 202 is open, at one side of pump assembly 30, to a collection chamber 212.

Cover 204 is provided with various annularly spaced holes, one of which is indicated at 214, aligned with a respective upstanding sleeve 215 projecting up from intermediate housing plate 189, as well as a respective mounting boss (not shown) formed integral with bottom wall 8. Upon aligning these components in this manner, fastening components are placed through a respective hole 214 and sleeve 215 and secured within respective mounting bosses. In the embodiment shown, intermediate housing plate 189 locates a stationary flow plate indicated at 218. Stationary flow plate 218 is preferably welded inside housing 221 and includes an upwardly extending cylindrical portion that receives a metal shaft (not shown) for rotatably supporting wash arm 47. Rotating below stationary flow plate 218 is a pump component or impeller 220. In any event, impeller 220 is drivingly connected to driveshaft 170 so as to rotate within a housing 221 during operation of motor 165. Although further details will be provided below, at this point, it should be noted that flow plate 218 and impeller 220 collectively define a recirculating pump (not separately labeled) incorporated in the overall pump assembly 30. In general, the structure described above is known in the art and set forth in greater detail in commonly assigned U.S. patent application Ser. No. 10/186,739 entitled "DISHWASHER PUMP AND FILTRATION SYSTEM" filed on Jul. 2, 2002 and herein incorporated by reference. The present invention is particularly directed to a soil chopping system 260 incorporated into pump assembly 30, with soil chopping system 260 being employed to macerate food particles entraining in the washing fluid.

As best shown in FIGS. 5-9, soil chopping system 260 includes a chopper blade 264 that is driven by driveshaft 170 about an apertured plate 267. As clearly shown in FIG. 5, apertured plate 267 actually includes a plurality of spaced holes 269 which are sized to permit only the passage of predetermined sized particles that are entrained within the washing fluid. In accordance with a preferred form of the invention, chopper blade 264 floats or axially slides relative to driveshaft 170 so as to be shiftable relative to apertured plate 267. Towards that end, chopper blade 264 is mounted to a hub member 275 and, in accordance with the most preferred form of the invention, chopper blade 264 can axially shift from a first position wherein chopper blade 264 is spaced from apertured plate 267, to a second position wherein chopper blade 264 is located closer to or directly adjacent apertured plate 267 in a manner which will be detailed more fully below.

Figure 7:
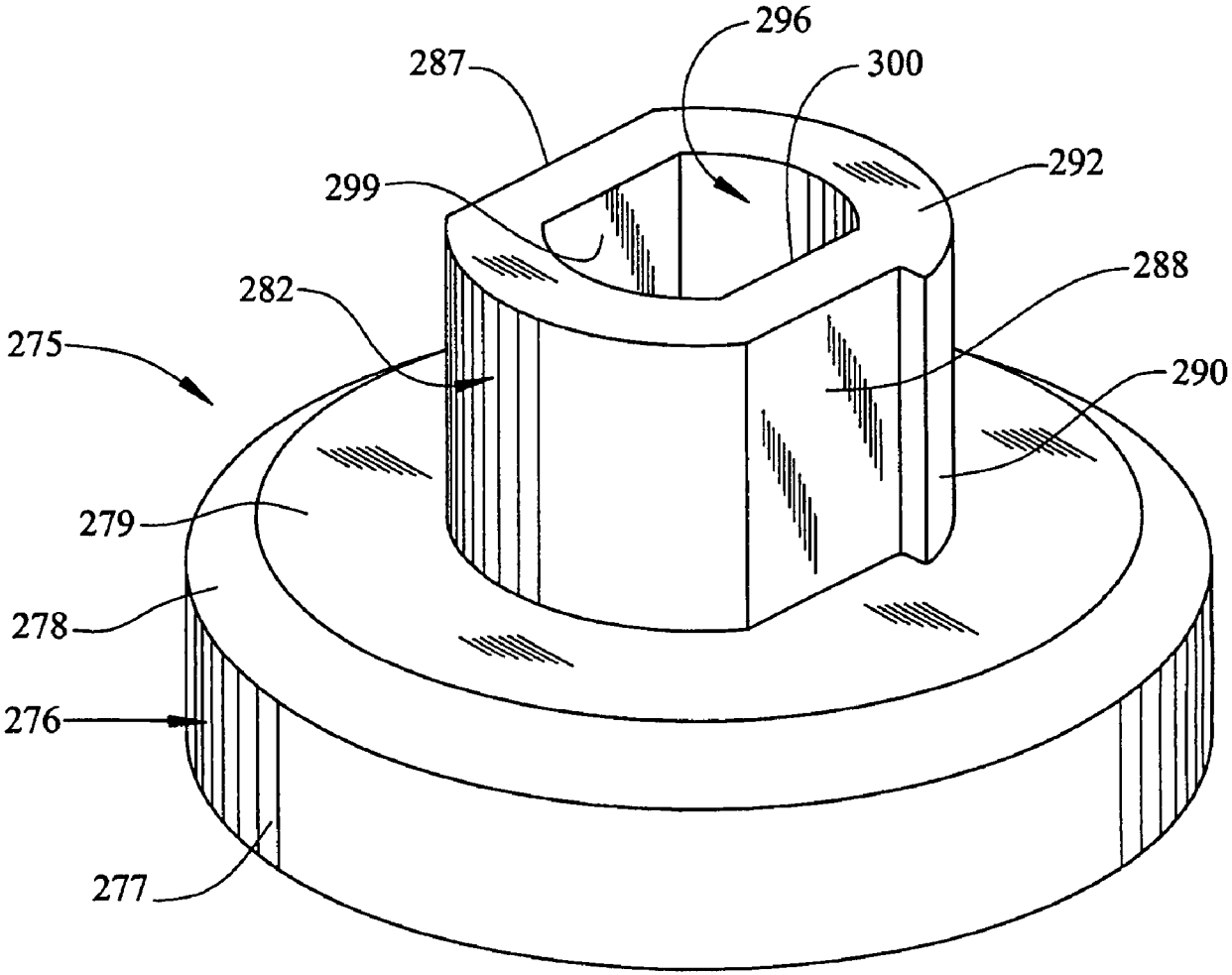
FIG. 7 is a perspective view of a hub member portion of the chopper blade and plate arrangement of the present invention.

As best shown in FIG. 7, hub member 275 includes a flange portion 276 having an outer peripheral edge 277. Outer peripheral edge 277 extends through a curved or tapered portion 278 to an upper, generally flat surface 279. Hub member 275 further includes a shaft portion 282 that projects, substantially perpendicularly, from upper surface 279. In accordance with the present invention, shaft portion 282 includes first and second drive flats 287 and 288 which, as will be discussed more fully below, engage with chopper blade 264. Additionally, one of the drive flats, for example 288, is provided with a locating tab element 290 that forces the positioning of chopper blade 264 in a predetermined orientation during an overall assembly process. In any event, shaft portion 282 includes a top or seating surface 292 which, as will be discussed more fully below, is adapted to abut a portion of impeller 220. Hub member 275 is provided with a central bore 296 that extends through both shaft portion 282 and flange portion 276. Central bore 296 includes first and second opposing flat zones 299 and 300 that are sized to engage with opposing flat regions 370 on driveshaft 170 such that hub member 275 rotates in unison with driveshaft 170.

With this particular arrangement, once motor 165 begins operation, driveshaft 170 rotates impeller 220 to create a flow of washing fluid that is drawn upward through apertured plate 267. The upward flow of washing fluid acts upon chopper blade 264, causing chopper blade 264 to slide axially relative to shaft portion 282 of hub member 275 upward to position chopper blade 264 directly adjacent to apertured plate 267. At this point, it should be noted that, when chopper blade 264 is moved directly adjacent to apertured plate 267, a predetermined spacing or clearance exists between chopper blade 264 and apertured plate 267, as established by a flange portion (not separately labeled) of bushing 306, so that an efficient mincing operation can be performed. In the event that a large food particle becomes trapped between chopper blade 264 and apertured plate 267, chopper blade 264 will momentarily deflect downward along an axis defined by shaft portion 282 and driveshaft 170 to prevent jamming by allowing the large particle to dislodge and be appropriately macerated. The relatively minimum spacing between apertured plate 267 and chopper blade 264 lowers an overall noise output by the operation of pump assembly 30 by reducing the potential for turbulences to form. Top surface 292 of shaft portion 282 abuts a step 304 (see FIG. 8) formed in impeller 220. Thus, once washing fluid begins to flow, chopper blade 264 will be urged along shaft portion 282, sliding upwardly into contact with bushing 306 (see FIG. 5) associated with apertured plate 267, until chopper blade 264 contacts bushing 306.

Hub member 275 is part of a stack (not separately labeled) which includes impeller 220 and shaft seal 307. As shown, shaft seal 307 includes a stationary seal ring 308, a rubber boot 309 and a spring 310 which rests upon a cup washer 311. With this arrangement, a fastener (not shown) threaded into a central portion 312 of driveshaft 170 forces impeller 220 downward, compressing shaft seal 307 and preventing fluid from entering into upper motor end cap 168.

In accordance with one aspect of the present invention, the flow of washing fluid urges chopper blade 264 upward toward bushing 306. With the described arrangement, hub member 275 also serves as a secondary drive member for impeller 220. More specifically, inner impeller hub 313 includes flat portions 315 and 316 that cooperate with drive flats 287 and 288 located on shaft portion 282. Moreover, flat portion 315 includes a tab receiving element 317 that cooperates with locating tab element 290 in order to locate or position impeller 220 on shaft portion 282. In addition, inner impeller hub 313 is provided with a central recess 319 (see FIG. 8) within which is positioned an O-ring 320 on step 304. With this arrangement, shaft portion 282 abuts and is cushioned and sealed by O-ring 320 when entering into impeller hub 313.

Figure 9:
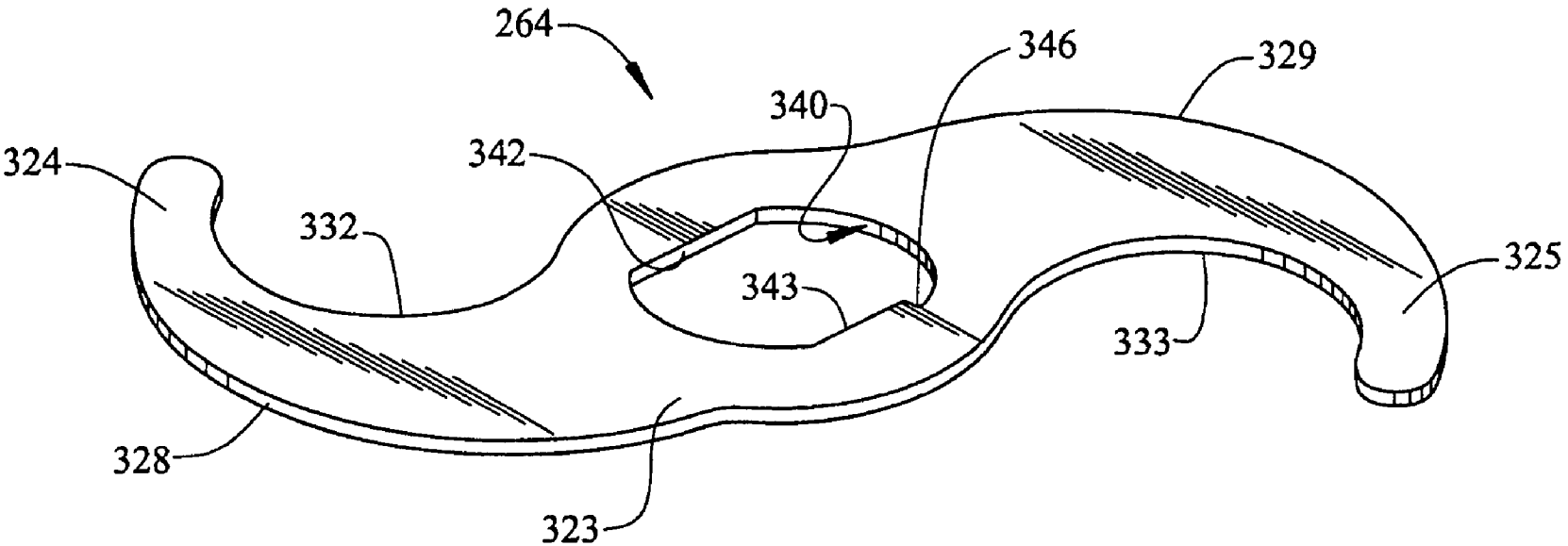
FIG. 9 is a perspective view of the chopper blade having first and second cutting arms.

As represented in FIG. 9, chopper blade 264 is preferably formed from a steel plate 323 having first and second opposing cutting arms 324 and 325. Each cutting arm 324 and 325 includes exterior curved portions 328 and 329 and interior curved portions 332 and 333 which form a generally S-shaped profile for chopper blade 264. Additionally, chopper blade 264 is provided with a central mounting opening 340 that is sized and shaped so as to be mounted upon shaft portion 282 of hub member 275. Towards that end, central opening 340 includes first and second drive flats 342 and 343 that correspond to first and second drive flats 287 and 288 on shaft portion 282. One of the drive flats, for example 343, is provided with a notch 346 that aligns with locating tab element 290 on shaft portion 282. With this particular arrangement, chopper blade 264 can be positioned upon hub member 275 in a particular, fixed orientation for proper operation.

Having described a preferred construction, reference will now be made to FIGS. 5-8 in describing a preferred method of assembling the soil chopping system of the present invention. The stack, made up of hub member 275, impeller 220 and seal 307, is assembled in the following manner: Initially, seal assembly 307 is pressed into central recess section 148 located in a central portion of lower housing plate 145. Motor 165 is then attached to an underside of lower housing plate 145 with driveshaft 170 protruding upwardly through a center portion (not separately labeled) of seal assembly 307. Hub member 275 is assembled over driveshaft 170 with first and second flat zones 299 and 300 of shaft portion 282 drivingly engaging flat regions 370 on driveshaft 170.

Figure 6:
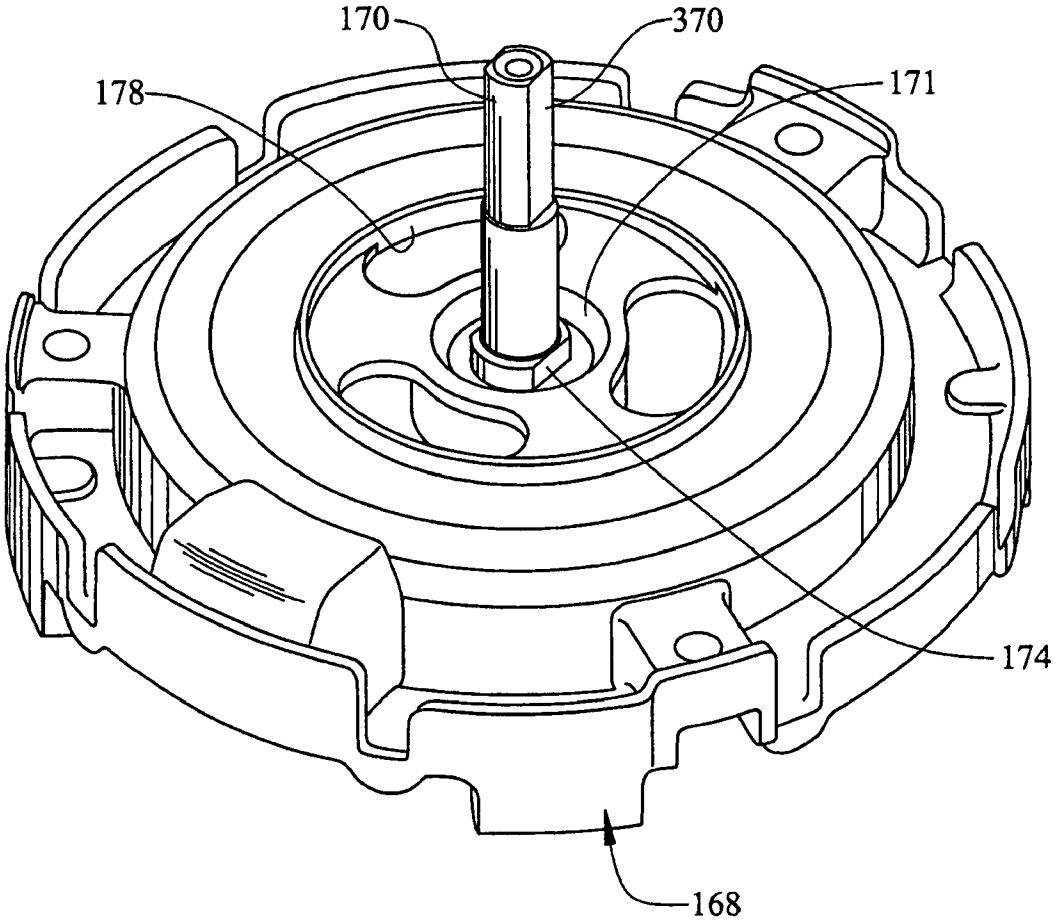
FIG. 6 is a perspective view of a motor housing portion of the pump/filtration system.

At this point, chopper blade 264 is assembled to shaft portion 282 of hub member 275 with first and second drive flats 342 and 343 respectively engaging first and second drive flats 287 and 288 of hub member 275. Notch 346 is also engaged with locating tab 290 so that chopper blade 264 can only be oriented and assembled to shaft portion 282 in one direction. Chopper blade 264 is free to move axially along shaft portion 282 in response to water flowing toward apertured plate 267 and an intake portion (not separately labeled) of impeller 220. As shown in FIGS. 5 and 6, intermediate housing 189 has assembled thereto apertured plate 267 and bushing or thrust washer 306 forming a sub-assembly. The sub-assembly is then attached to lower housing plate 145 with part of shaft portion 282 extending upwardly through apertured plate 267 and over driveshaft 170.

Figure 8:
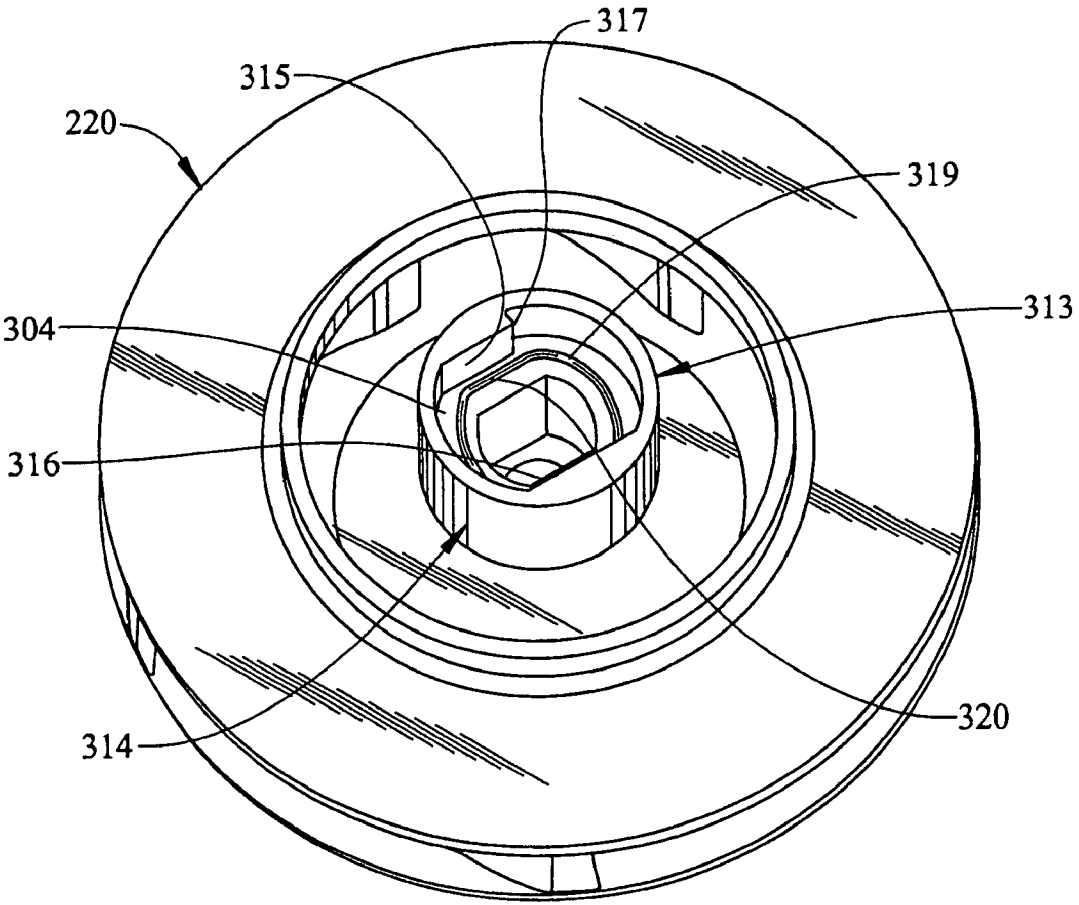
FIG. 8 is a lower perspective view of an impeller portion of the pump/filtration system.

Further, as best shown in FIG. 8, impeller 220 includes lower cavity region 314 with flats 315 and 316 and tab receiving element 317 that correspond directly to flats 287 and 288 and locating tab 290 of shaft portion 282. Impeller 220 is placed over driveshaft 170 to align these features. In addition, another flatted portion (not separately labeled) of lower cavity region 314 engages with a drive flat 370 of driveshaft 170. O-ring 320 provides a water tight seal between impeller 220 and top seating surface 292 of shaft portion 282. Preferably, top surface 292 abuts a step 304 formed in the impeller 220. At this point, an appropriate threaded fastener (not shown) is driven into a central portion (not separately labeled) of driveshaft 170 to secure the stack to driveshaft 170. When the fastener is tightened, the combination of impeller 220 and hub 275 compresses spring 310 of seal 307 to provide proper tension on stationary seal 307 and a mating rotating seal washer 380 associated with a bottom portion of hub 275, thereby ensuring a water tight rotating seal.

With this overall construction, soil chopping system 260 provides a unique method of positioning a chopper blade relative to an apertured plate. That is, chopper blade 264 is only positioned directly adjacent to apertured plate 267 when a flow of washing fluid is recirculating within pump assembly 30. Thus, in the event that pump assembly 30 becomes starved or motor 165 is otherwise not in operation, chopper blade 264 remains in a position spaced from apertured plate 267. This overall construction enables the production of a dishwasher having a substantially reduced noise output, while still ensuring a proper spacing between the chopper blade and the apertured plate in a manner which enhances the chopping operation. In addition, the construction reduces wear on bushing 306 in the event pump assembly 30 should be operated without washing fluid.

Although described with reference to a preferred embodiment of the present invention, it should be readily apparent to one of ordinary skill in the art that various changes and/or modifications can be made to the invention without departing from the spirit thereof. For instance, while the chopper blade is described as being fixed to the hub member, the chopper blade itself could slide towards the apertured plate relative to the hub member. In addition, the "S"-shaped chopper blade configuration could take different forms. Furthermore, it should be readily apparent that the drive flats on the hub member could be replaced with splines or the like. Finally, although the chopping system of the invention has been disclosed for use in connection with a recirculating pump of a dishwasher, the chopping system could also be employed in connection with a drain pump arranged in an associated pumping chamber. In general, the invention is only intended to be limited to the scope of the following claims.

We claim:

1. A method of macerating food particles entrained in washing fluid of a dishwasher comprising:

activating a drive motor to rotate a driveshaft, along with a hub member and an impeller coupled to the driveshaft;

establishing a flow of washing fluid through operation of the impeller with the washing fluid flowing through an apertured plate arranged between the hub member and the impeller; and shifting a chopper blade attached to the hub member from a first position, which is spaced from the apertured plate a first distance, to a second position which is closer to the apertured plate, wherein, when in the second position, said chopper blade is adjacent the apertured plate and rotation of the hub member imparts a rotation to the chopper blade to macerate food particles entrained in the flow of washing fluid, wherein activation of the motor causes rotation of the chopper blade and operation of the impeller which establishes the flow of washing fluid that causes the chopper blade to shift from the first position wherein the chopper blade is spaced from the apertured plate by the first distance to the second position wherein the chopper blade is moved closer to the apertured plate for macerating food particles entrained in the flow of washing fluid and in an event that the impeller starves or ceases to operate, the chopper blade remains in a position spaced from the aperture plate.

2. The method of claim 1, wherein the chopper blade shifts relative to the hub member between the first and second positions.

3. The method of claim 1, further comprising: sealing between the hub member and the driveshaft to prevent the washing fluid from reaching the drive motor.

4. The method of claim 1, further comprising: tensioning a seal to prevent the flow of washing fluid from leaking about the hub member.

5. The method of claim 1, further comprising: allowing the chopper blade to momentarily shift from the second position towards the first position if the chopper blade impacts a large soil particle.

6. The method of claim 1, further comprising: imparting a driving force to the impeller through the hub member.

7. The method of claim 6, further comprising: engaging a drive flat provided on the hub member with a corresponding flat portion of the impeller to fix rotation of the impeller with the hub member.

8. The method of claim 1, further comprising: establishing a desired orientation of the hub member and the impeller through inter-engagement of a location tab element provided on the hub member with a locating tab receiving element arranged on the impeller.

9. The method of claim 8, further comprising: establishing a desired orientation of the chopper blade relative to the hub member by inter-engagement of the locating tab element with a notch formed in the chopper blade.

* * * * *